US006287049B1

(12) United States Patent
Keinholz

(10) Patent No.: US 6,287,049 B1
(45) Date of Patent: Sep. 11, 2001

(54) LAYERED FOUNDATION FOR PLAY SURFACE

(76) Inventor: Shane E. Keinholz, 8070 Hwy. 55, Apt. 313 Rockford, MN (US) 55373

( * ) Notice: Subject to any disclaimer, the term of this patent is extended or adjusted under 35 U.S.C. 154(b) by 0 days.

(21) Appl. No.: 09/271,799

(22) Filed: Mar. 18, 1999

(51) Int. Cl.[7] ..... E02B 13/00

(52) U.S. Cl. ..... 405/46; 405/38; 405/36; 472/92

(58) Field of Search ..... 405/36, 38, 50, 405/43, 45, 52; 404/27, 31, 32; 472/92; 473/490

(56) References Cited

U.S. PATENT DOCUMENTS

| | | | | |
|---|---|---|---|---|
| 3,446,122 | * | 5/1969 | Raichle et al. | 473/490 |
| 3,801,421 | * | 4/1974 | Allen et al. | 404/32 |
| 4,044,179 | | 8/1977 | Haas, Jr. | 428/17 |
| 4,396,653 | | 8/1983 | Tomarin | 428/17 |
| 4,679,963 | | 7/1987 | Heath | 405/36 |
| 4,991,834 | | 2/1991 | Vaux | 272/3 |
| 5,014,462 | | 5/1991 | Malmgren et al. | 47/1.01 |
| 5,026,207 | | 6/1991 | Heath | 405/46 |
| 5,076,726 | | 12/1991 | Heath | 405/38 |
| 5,100,258 | * | 3/1992 | Van Wagoner | 405/50 |
| 5,182,137 | * | 1/1993 | Allen | 404/31 |
| 5,254,039 | | 10/1993 | Garcia | 472/92 |
| 5,525,416 | * | 6/1996 | Katz et al. | 405/36 |
| 5,961,389 | * | 10/1999 | Dickinson | 472/92 |

OTHER PUBLICATIONS

Handbook for Public Playground Safety r; U..S. Consumer Product Safety Commission; Pub. No. 325 (1994).
Environmental Fact Sheet; United States Enviornment Protection Agency; Nov. 1997.
"1997 Buy–Recycled Series Park and Recreation Products"; Environmental Protection Agency; Nov. 1997.
America Tire Recyclers, Inc.; brochure (undated).
"How Hard He Lands Depends on You"; Fiber Systems; woodcarpet; brochure (1992).
"Engineered Wood Fiber Playground Surface"; woodcarpet brochure (undated).
Sports Turf; American Tire Recyclers, Inc.; playground surfacing; brochure (undated).
Sports Turf; Recycled Florida Tire Granules; American Tire Recyclers; brochure (undated).
Play Turf; Landscape Structures, Inc. (Jan. 1996).
Woodcarpet Playground Safety Surface Report (1998).

* cited by examiner

*Primary Examiner*—David Bagnell
*Assistant Examiner*—Frederick L. Lagman
(74) *Attorney, Agent, or Firm*—Larkin, Hoffman, Daly & Lindgren, Ltd.; Frederick W. Niebuhr, Esq

(57) ABSTRACT

A layered foundation for a play surface includes an upper layer formed of wood mulch or another landscaping loose-fill material, a support layer composed of multiple fragments of a resilient material such as vulcanized rubber, and a landscaping fabric sheet disposed between the upper layer and the support layer. The support layer, preferably 3–4 inches in depth, contributes considerably to the shock-absorbing capability of the foundation, to provide a foundation that meets or exceeds recommended levels of impact attenuation, yet has a total depth less than that considered necessary in conventional foundations or support systems. The support layer also effectively drains water from the upper layer, due to multiple, interconnected passages between fragments. The upper layer covers the support layer at a preferred thickness of at least six inches, preventing exposure of the support layer and thus minimizing any hazards that might arise from the characteristics of the rubber or other elastomer used in the support layer. The barrier layer further ensures that the support layer remains covered, and enables a removal and replacement of the upper layer material, if desired, without disturbing the support layer.

28 Claims, 2 Drawing Sheets

LAYERED FOUNDATION FOR PLAY SURFACE

BACKGROUND OF THE INVENTION

The present invention relates to playgrounds and other recreational areas, and more particularly to layered base and sub-base constructions supporting recreational surfaces.

Years ago, most playgrounds and other recreational areas had natural grass surfaces. Natural grass, although suitable for play surfaces, requires ongoing maintenance, e.g., mowing and weed control. The underlying soil is subject to erosion, and may exhibit poor drainage. In certain heavily used areas of the play surface, the soil tends to become compacted. This prevents the growth of grass, giving the play surface an undesirable appearance. Also, the compacted soil as compared to undamaged turf has a reduced capacity to absorb shock, and thus presents an increased risk of injury due to falls.

Given the above disadvantages, designers of recreational areas have turned to alternatives, including a variety of loose-fill materials such as sand, gravel, wood mulch, wood chips and rubber particles or fragments.

Rubber particles are receiving more attention now, largely due to concerns about playground safety, particularly with respect to reducing injury due to impact from a fall onto the play surface. The U.S. Consumer Product Safety Commission, in a study of equipment-related injuries on playgrounds, has concluded that the majority of such injuries occur due to falls from the equipment to the ground surface below the equipment. The Commission has tested a variety of loose-fill materials used in constructing playgrounds and recreational sites, determining, with respect to a particular material, a "critical height" for a given thickness of a layer of the material. The critical height is the maximum height from which an instrumented metal head form, upon impact, yields (1) a peak deceleration of no more than 200 g's, and (2) a head injury criterion (HIC) of no more than 1,000. The HIC measurement takes into account the duration of an acceleration as well as the acceleration itself. In any event, the critical height is intended to approximate the maximum height of a fall from which a life-threatening head injury is not expected.

The loose-fill materials for which critical height information is available include wood mulch, double shredded bark mulch, uniform wood chips, fine sand, coarse sand, fine gravel, and medium gravel with particles up to about ½ inch in diameter. At a material depth of 6 inches, wood mulch exhibits the best critical height, i.e. 7 feet. At a depth of 12 inches, uniform wood chips provide the only uniform height above 12 feet. Wood mulch and double shredded bark mulch exhibit critical heights of 11 feet at the 12-inch depth. By comparison, coarse sand and medium gravel at that depth have critical heights of 6 feet.

Particles of rubber or other elastomers are expected to exhibit critical heights superior to the critical heights of the tested materials, given their superior resilient and shock absorbing qualities. However, ultraviolet rays deteriorate the appearance of rubber particles. Also, there are several safety concerns, including a potential fire hazard, and the possible attractiveness of rubber particles to small children, who may consume the particles or choke on larger particles.

All loose-fill materials require a border or wall for containing the material. Walls can be formed by excavation or by above-ground components, e.g. landscaping ties or blocks of concrete or stone. To avoid the need for containment, a variety of synthetic products have been developed. These include continuous matting, or combinations of base sheets with upright synthetic fibers or pile to simulate grass. Some of the synthetic layers incorporate ribs to form compartments for either ambient or compressed air, as in U.S. Pat. No. 4,991,834 (Vaux), and U.S. Pat. No. 5,254,039 (Garcia).

Other turf designs have incorporated loose-fill materials. For example, U.S. Pat. No. 4,396,653 (Tomarin) discloses a synthetic pile carpet including a base sheet and synthetic fibers extending vertically from the base sheet to simulate grass. A layer of rubber particles, i.e. "crumb rubber" is applied over the base sheet, with a coarser, sand-like layer applied over the rubber particles. Both particulate layers thus intermingle with the upright synthetic fibers. In U.S. Pat. No. 4,044,179 (Haas), a recreational area construction includes a subsurface, a pile fabric including a backing and upstanding elements to simulate grass, and granular material distributed among the upstanding elements. A primary concern with synthetic turf or matting is the prohibitive expense.

In connection with rubber particles as a loose-fill, U.S. Pat. No. 5,014,462 (Malmgren) discloses the use of solid rubber particles mixed into soil, primarily to reduce soil compaction and improve porosity. In U.S. Pat. No. 5,714,263 (Jakubisin), rubber slivers are encapsulated within a protective resin film, said to be decorative, color-fast and weather-resistant.

Several layered loose-fill constructions are disclosed in U.S. Pat. No. 5,026,207 (Heath), including a top layer of wood fiber, a resilient open mesh beneath the wood fiber, and a fabric layer (felt) beneath the open mesh. In an alternative construction, a fabric layer also is provided above the open mesh, between the mesh and the wood fiber. U.S. Pat. No. 4,679,963 (Heath) and U.S. Pat. No. 5,076,726 (Heath) disclose further layered constructions, e.g. a stone layer wrapped in a fabric layer, beneath a wood fiber layer.

Although each of the foregoing constructions is useful under certain conditions, there remains a need for a play surface foundation that affords good impact attenuation (shock absorbing quality), meets other safety criteria, maintains an attractive appearance, facilitates the use of recycled material, and is suitable for upgrading preexisting playgrounds and other recreational areas, as well as new construction.

SUMMARY OF THE INVENTION

To meet the above and other needs, there is provided a layered foundation for a play surface. The foundation includes an upper layer consisting essentially of a landscaping loose-fill material, that defines a play surface and has a thickness extending downward from the play surface. A support layer is disposed beneath the upper layer, and consists essentially of multiple fragments of a water impermeable resilient material, in particular a material more elastic than the landscaping loose-fill material. The fragments contact one another, cooperating to define multiple interconnected passages throughout the support layer to promote drainage. The fragments are elastically compressible in response to an application of a downward force through the upper layer.

The foundation preferably also includes a barrier layer between the upper layer and the support layer. The barrier is water permeable, but tends to prevent an intermingling of the landscaping loose-fill material and the resilient material fragments.

In preferred versions of the foundation, the resilient fragments have maximum dimensions of at most about 1 inch, more preferably about ⅜ of an inch, or have maximum and minimum dimensions with the maximum dimension being at most about twice the minimum dimension. The resilient material preferably is an elastomer, consisting essentially of at least one of the following: vulcanized natural rubber, a butylene-styrene copolymer, neoprene, a butylene acrylonitrile copolymer, and butyl rubber. A particularly preferred material consists essentially of recycled shredded or crumbed rubber, e.g. from automobile tires.

The landscaping loose-fill material can consist essentially of at least one of the following: wood fiber (wood mulch, bark mulch, wood chips), sand, and gravel. Among these, wood mulch (sometimes also called engineered wood fiber) is a particularly preferred upper layer material because of the intermingling of separate components or pieces, which provides a surface better suited to support wheel chairs to improve handicapped access.

The claimed foundation also addresses several safety concerns. First, a foundation depth composed of the landscaping loose-fill material and the resilient fragments has a shock absorbing quality substantially superior to that of a foundation having a similar depth and consisting of the loose-fill material. The impact of a fall is transmitted through the upper layer and is absorbed in the support layer as the resilient fragments are compressed. After the impact, the fragments resiliently recover. As compared to a mesh composed of strands of a resilient material, the fragments exhibit better shock absorbing quality and elastic recovery due to the action of the fragments as compared to the strands of a mesh, i.e. compression as opposed to bending.

Several advantages arise from the use of resilient fragments in the support layer, beneath the loose-fill material. For example, the resilient fragments are unseen by and largely inaccessible to small children, minimizing concerns regarding consumption of the fragments. Hazards arising from the flammable tendencies of rubber and other elastomers are diminished when the support layer is covered by a thickness of a landscaping loose-fill material and fabric barrier. The layered arrangement permits the use of resilient fragments from recycled tires, which otherwise might not be suitable for playgrounds or other recreational areas. Specifically, the belts in radial tires result in a proportion of the rubber fragments containing metal pieces or fragments, precluding the use of such fragments in exposed surface areas. These fragments can be employed in constructing the present layered foundation.

Further, since the appearance of the resilient fragments is of no concern, there is no need to treat the fragments with a resin film to enhance their appearance or their resistance to ultraviolet rays.

Because of the shock absorbing quality of the support layer, impact attenuation and critical height requirements can be met with a substantially reduced depth when this layered construction is employed. Thus, landscaping ties or other common border materials can more easily contain the loose-fill material. As a result, the layered construction is more readily used to "retrofit" a previously built playground or recreation area, because the required improvement in impact attenuation is achieved without increasing the material depth, and in some cases despite a reduction in material depth.

Further in accordance with the present invention, there is provided a process for constructing a foundation for a play surface, including the following steps:

a. forming a boundary for defining a play surface area for containing loose-fill materials within the play surface area;

b. pouring a first loose-fill material composed of resilient fragments within the play surface area, then substantially leveling the resilient loose-fill material to provide a resilient layer having a depth less than a height of the boundary;

c. after pouring the resilient loose-fill material, installing a water permeable barrier layer above the resilient layer; and d. after installing the barrier layer, pouring a landscaping loose-fill material having an elasticity less than that of the resilient material, above the barrier layer, and leveling the landscaping loose-fill material to provide a substantially level play surface surrounded by the boundary.

Thus, in accordance with the present invention, a layered foundation provides and supports the surface of a playground or other recreation area, enhancing the utility of the surface in terms of better shock attenuation, reduced risk of injury from possible consumption of elastomeric fragments and from their flammability, improved drainage, lower cost, reduced maintenance and enhanced appearance.

IN THE DRAWINGS

For a further understanding of the above and other features and advantages of the invention, reference is made to the following detailed description and to the drawings, in which.

Figure 1:
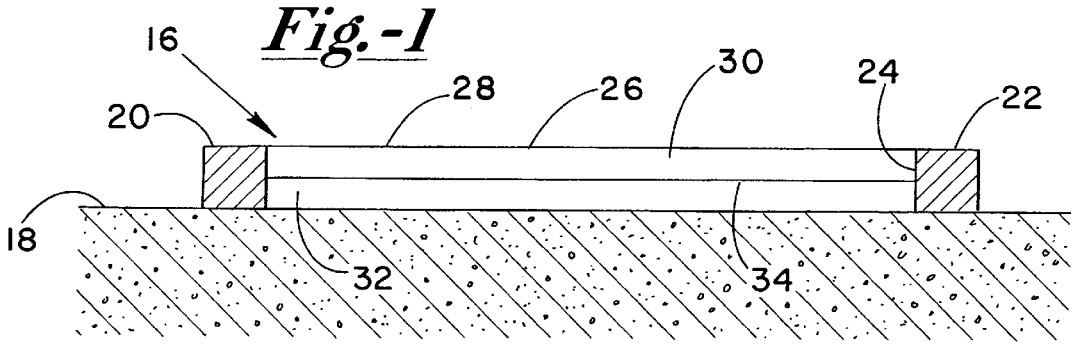
FIG. 1 is a sectioned elevation showing a layered play area foundation constructed in accordance with the present invention.
Figure 2:
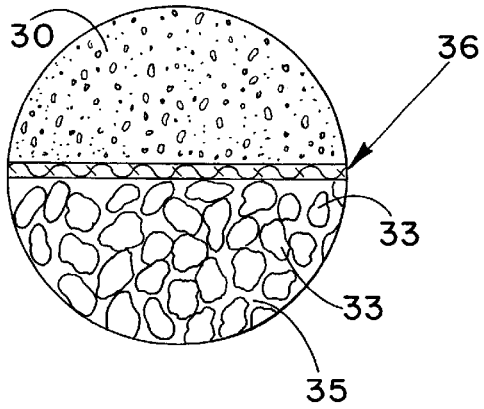
FIG. 2 is an enlarged view of a portion of FIG. 1.
Figure 6:
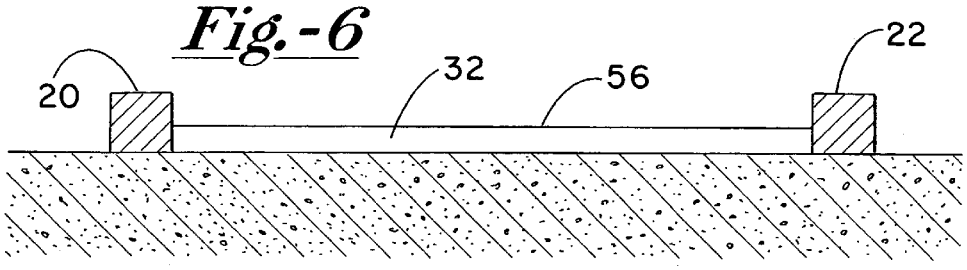
Figure 7:
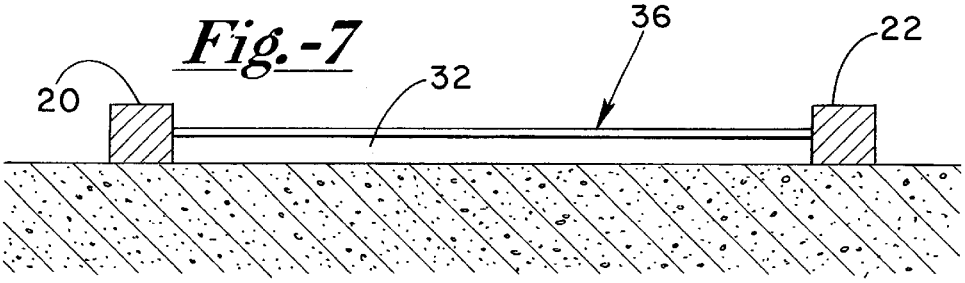
Figure 8:
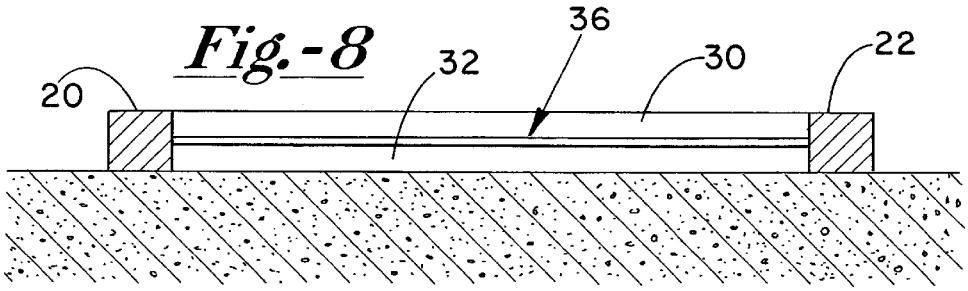
Figure 9:
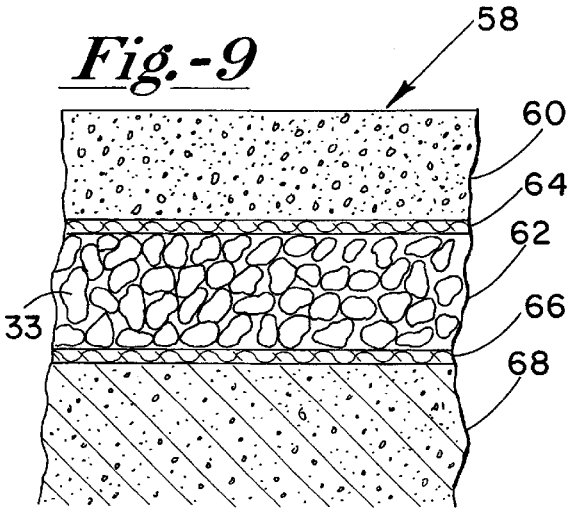
Figure 10:
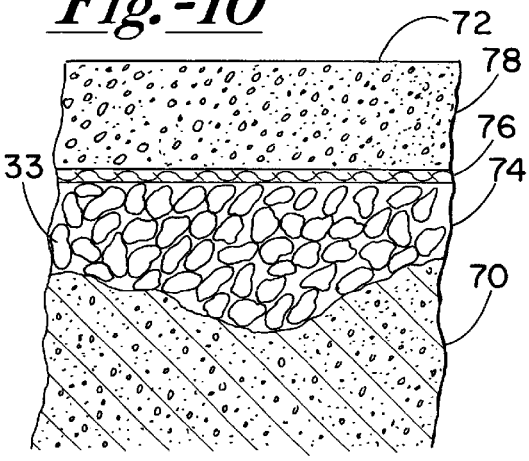

FIGS. 6–8 schematically illustrate a sequence of steps for installing the foundation shown on FIGS. 1 and 2;

FIG. 9 is a sectioned elevation of an alternative embodiment foundation constructed according to the present invention; and FIG. 10 is a sectioned elevation of another alternative embodiment foundation.

DETAILED DESCRIPTION OF THE PREFERRED EMBODIMENTS

Turning now to the drawings, there is shown in FIG. 1 a playground surface and support system 16 that embodies the present invention. The system is above-ground, the ground being indicated at 18. A series of landscaping ties, two of which are shown at 20 and 22, form a boundary to define the play surface shape and provide an interior wall 24 for material containment. A foundation 26 having a substantially planar and level upper surface 28 is surrounded by the landscaping ties. Alternatively, the boundary containing the foundation can be formed of stones, blocks or other masonry. Yet another alternative is excavation of an opening for the foundation, which facilitate locating surface 28 at or approximately at ground level.

Foundation 26 is laminar, consisting of an upper layer 30 of a landscaping loose-fill material, a lower, support layer 32 composed of resilient fragments or pieces, and a barrier layer 34 between layers 30 and 32.

Upper layer 30 preferably is formed of a wood fiber, including wood mulch with pieces of a variety of sizes and sometimes including bark and twigs as well. The desired depth of upper layer 30 depends on several factors. The primary factor in determining the depth is the desired level of safety for foundation 26, in terms of the critical height standard discussed above. Considering upper layer 30 alone, the critical height is increased by increasing the upper layer depth. Another factor is drainage, which is enhanced by reducing the upper layer depth. In practice, the depth of upper layer 30 is preferably within the range of six inches to eight inches. Wood mulch is preferred for the upper layer due to favorable impact attenuation characteristics as noted above, permeability resulting in sufficient drainage, and the capacity to support a wheelchair and thus meet accessibility standards under the Americans with Disabilities Act.

Wood chips afford the same favorable characteristics for upper layer 30. Other suitable alternative materials include bark mulch, sand (preferably coarse), and gravel.

Support layer 32 is composed of fragments 33 of natural rubber, in particular shredded or crumbed rubber recycled from vehicle (primarily automobile) tires. The fragments tend to be irregular in shape as best seen in FIG. 2. Each of the fragments preferably has a minimum dimension ("diameter" across the narrowest fragment region) of at least about one-fourth of an inch, and more preferably about three-eighths of an inch. Similarly, each fragment has a maximum dimension of at most about one inch, and more preferably about three-fourths of an inch, so that preferred fragments have maximum dimensions at most about double their minimum dimensions. In general, the shape of the fragments is not critical. For example, spherical fragments would function well. The critical factor is that regardless of the individual fragment shapes and sizes, multiple fragments cooperate to provide multiple interconnected interstitial passages 35 to accommodate a substantial flow of water through support layer 32, given the fact that the fragments themselves are substantially water impermeable, thus to promote drainage of water from the upper layer through the support layer.

The preferred material for support layer 32 is vulcanized natural rubber. In particular, rubber from shredded or crumbed tires is readily available and relatively inexpensive. Alternative materials for the resilient fragments include butadiene-styrene copolymers, neoprene, butadiene-acrylonitrile copolymers, and butyl rubber.

Figure 3:
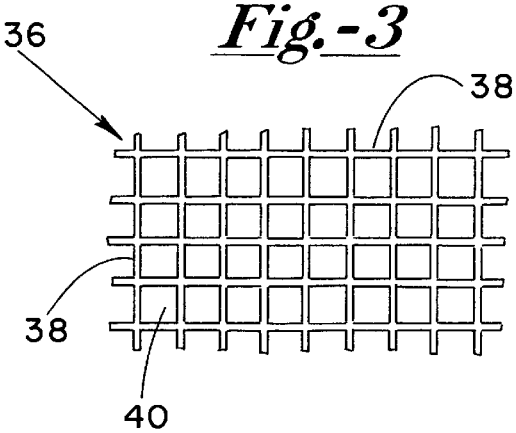
FIG. 3 is a top plan view of a landscaping fabric layer shown apart from the foundation of FIGS. 1 and 2.

Barrier layer 34 consists of a sheet 36 of woven or non-woven water permeable landscaping fabric, typically felt. As seen in FIG. 3, strands 38 of the fabric are interwoven to form multiple openings 40, sufficiently large to render the fabric water permeable, and sufficiently small to substantially prevent passage of resilient fragments 33 or components of the wood mulch, thus to segregate the upper layer and support layer. This preserves the integrity of the layers, and also facilitates the removal and replacement of upper layer 30, if necessary, without disturbing the underlying support layer.

Another advantage arises when strands 38 of the landscaping fabric are pliable, yet substantially resistant to elongation under tensile stress. Such strands form a fabric layer that is resistant to highly localized deformation in response to forces applied downwardly through layer 30. For example, a localized deformation of the upper layer, such as might be caused by the wheels of a wheelchair on surface 28, is transmitted downwardly through the layer 30, particularly if the layer is formed of sand or gravel. When fabric sheet 36 is composed of elongation-resistant strands, it does not replicate the deformation to upper surface 28, but instead attenuates the vertical deformation and distributes the deformation horizontally over a wider area, resulting in a wider but shallower deformation of the fabric. By contrast, when the deformation of upper surface 28 is less confined, as when the deformation is due to a fall, there is less attenuation of the vertical component due to the fabric.

Figure 4:
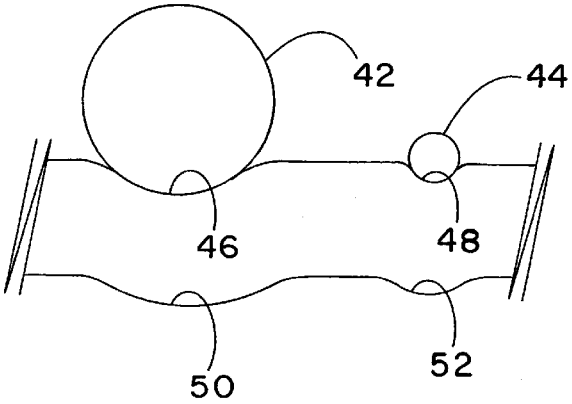
FIGS. 4 and 5 are schematic views illustrating the function of a resilient support layer of the foundation.

This difference is illustrated schematically in FIG. 4, where a circle 42 represents a relatively large object falling onto upper surface 28, and a smaller circle 44 represents a smaller object with a more localized impact on the surface.

The impact of object 42 forms a depression 46 in the upper surface. Object 44 forms a depression 48 having a much smaller horizontal dimension, but similar in depth to depression 46, which can occur if object 44 is denser and therefore heavier than the relative sizes of the objects would suggest. The vertical force due to impact of object 42 is transmitted downwardly through layer 30. Loose-fill material is pushed downwardly to compress fragments 33 and form a depression 50 in the fabric layer.

Similarly, the impact of object 44 forces loose-fill material against fabric sheet 36, forming a depression 52 and compressing the resilient fragments. In both cases, there is an attenuation of the vertical force component and displacement and a horizontal broadening, resulting in broader but shallower depressions in the fabric layer. In the case of the smaller object and more concentrated initial depression, the effect is more pronounced. The degree of attenuation and broadening is greater in both cases when the loose-fill material is wood mulch, bark mulch or wood chips, as opposed to sand and gravel. In any event, the attenuation and broadening increase the volume encompassing the fragments 33 that are resiliently compressed in response to a given impact or weight applied to upper surface 28. As a result, individual fragments undergo less elastic compression, which improves their elastic recovery.

Figure 5:
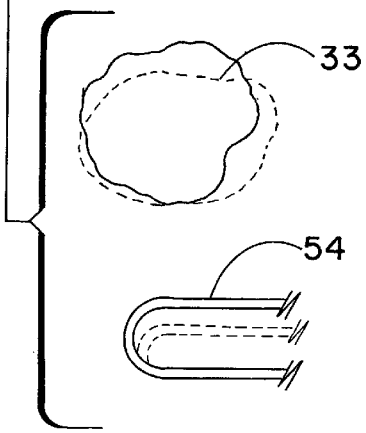

A further factor that enhances elastic recovery, as well as shock-absorbing capability, is the structure of support layer 32, more particularly the fact that the layer is composed of multiple fragments of the resilient layer, as opposed to an open mesh or fabric composed of elongated strands. As noted previously, fragments 33 undergo elastic compression in response to forces transmitted vertically through upper layer 30. By contrast, elongate strands, in a support layer having any appreciable depth, would respond to such vertical forces by elastic bending. This difference is illustrated in FIG. 5, showing one of fragments 33 and an elongate flexible strand 54, with broken lines in each case indicating the elastic deformation. For a support layer having the same depth as support layer 32, the result would be a decreased capability to absorb shock, and a reduced degree of elastic recovery after the force is removed. Such multiple strands if packed together may prevent drainage through the support layer, or at least reduce drainage to an unacceptable level.

By contrast, the interconnected, interstitial passages between the support layer fragments provide excellent drainage through support layer 32, which yields several advantages. Support layer 32 readily accepts and transfers water downwardly away from upper layer 30. Thus, moisture drains more rapidly from the upper layer after a rain, and in general the layer retains less moisture. Especially in the case of wood mulch, bark mulch or wood chips, the upper layer retains its favorable impact attenuation characteristics, and resists rot and other deterioration. The useful life of the loose-fill material is lengthened, and maintenance costs are reduced.

The desirability of maintaining a dry wood mulch is known. For example, it is a common practice to recommend installing drainage stone at a depth of 3–4 inches beneath wood mulch. A salient feature of the present invention is that a layer that increases the impact attenuation of the foundation, also provides excellent drainage.

FIGS. 6–8 illustrate a process for constructing system 16. Initially, some excavation may be required to provide reasonably level ground to support the foundation. However, assuming the ground is reasonably level, the first step is to form a boundary, in this case positioning a series of landscaping ties including ties 20 and 22. The boundary defines the play surface area, and contains the loose-fill and foundation materials within the play surface area.

With the boundary complete, a predetermined amount of the foundation material consisting of resilient fragments 33 is poured onto the ground within the area surrounded by the landscaping ties, then spread to provide a support layer of substantially uniform depth and having a substantially level upper surface 56. The result of these steps is shown in FIG. 6. The depth of the support layer preferably is at least 2 inches, and more preferably is in the range of 3–6 inches.

Next, the water permeable barrier layer is installed, specifically by laying sheeting 36 of the landscaping fabric onto the resilient loose-fill material. The result is shown in FIG. 7.

Next, landscaping loose-fill material is poured over the landscaping fabric, then spread to provide an upper layer having a substantially uniform thickness and a substantially level upper surface 28. The result is shown in FIG. 8. The preferred depth of upper layer 30 is at least 4 inches, more preferably 6–8 inches, although the depth may be increased up to 12 inches. A 6 inch depth, in combination with a support layer depth of 3 inches, provides at least as favorable shock absorbing characteristics (same or greater critical height) as a 12 inch layer of wood mulch. Reduced to 6 inches, the upper layer depth is easier to measure and monitor, an important factor in maintenance. The reduced thickness itself reduces maintenance, because the thinner layer of wood mulch more readily rids itself of moisture, given sufficient drainage beneath it.

Stone, bricks, concrete blocks or other masonry can be used in lieu of the landscaping ties to provide the boundary. As a further alternative, the boundary can be provided by excavation, to provide a foundation recessed into the ground, and an upper surface 28 approximately at ground level. Preferably, drainage tile or other means are provided to drain water from the support layer.

FIG. 9 illustrates an alternative embodiment foundation 58 including an upper layer 60 of a landscaping loose-fill material, a support layer 62 composed of resilient fragments 33 beneath the upper layer, a first landscaping fabric layer 64 between layers 60 and 62, and a second landscaping fabric layer 66 between the support layer and the ground 68. Fabric layers 64 and 66 are water permeable to promote drainage, yet impermeable to the loose-fill material and to the fragments. Fabric layer 64 performs the same function as fabric layer 34 in the first embodiment. Fabric layer 66, although it may admit soil upwardly into support layer 62, prevents fragments 33 from becoming embedded in the soil beneath the support layer. This facilitates a recovery of the resilient fragments, should there be a need to remove the foundation from the play surface area.

FIG. 10 illustrates an alternative approach to the process illustrated in FIGS. 6–8, in that ground 70 is not level, and no leveling of the ground occurs, except for whatever leveling might be required along the boundary for subsequent positioning of landscaping ties or masonry. In this case, the resilient loose-fill material composed of fragments 33 is poured onto the ground and leveled as before, resulting in a substantially level upper surface 72 and a support layer 74 that is non-uniform in its depth. Care is taken to ensure that the minimum depth of the support layer exceeds a certain threshold, e.g., two inches. Otherwise, the depth is not critical. Once surface 72 is substantially level, a landscaping fabric layer 76 and landscaping loose-fill material for an upper layer 78 are applied as before. This approach avoids the need to level the ground beneath the foundation. This approach also requires more of the resilient loose-fill material. However, when the material is shredded or crumbed rubber from recycled tires, the additional cost is not substantial with respect to the overall cost of the system. Further, the higher proportion of recycled rubber fragments can be an attractive feature, given the concern for using recycled or recovered materials when possible. While the embodiment illustrated in FIG. 10 involves a higher proportion of the resilient fragments, the preceding embodiments also can be constructed with a sufficiently high proportion of recovered materials to meet Environmental Protection Agency recommendations regarding recovered materials content for playground surfaces.

Thus, in accordance with the present invention, a play surface foundation uses resilient material to provide impact attenuation, while at the same time minimizing or avoiding hazards arising from the nature of the resilient material. A landscaping loose-fill material covers the resilient material, and can be advantageously selected for its contribution to shock attenuation, good appearance, and handicapped accessibility.

What is claimed is:

1. A layered foundation for a play surface, including:

an upper layer consisting essentially of a landscaping loose-fill material defining a play surface and having a depth extending vertically downward from the play surface; and a resilient support layer disposed beneath the upper layer and consisting essentially of a resilient loose-fill material composed of multiple fragments of a water impermeable resilient material more elastic than the landscaping loose-fill material, said fragments contacting one another and cooperating to provide a vertical support layer, and further cooperating to define multiple interconnected interstitial passages to promote drainage throughout the support layer, said fragments being elastically compressible in response to an application of a downward force through the upper layer.

2. The foundation of claim 1 further including:

a water permeable barrier between the upper layer and the support layer.

3. The foundation of claim 2 wherein:

said barrier comprises a landscaping fabric.

4. The foundation of claim 3 wherein:

said landscaping fabric is adapted to provide tensile strength in horizontal directions, whereby the fabric tends to resist localized deformations in response to vertical forces transmitted through the upper layer.

5. The foundation of claim 2 wherein:

said barrier is contiguous with the upper layer and the support layer, and tends to prevent an intermingling of the landscaping loose-fill material and the resilient material.

6. The foundation of claim 2 further including:

a second water permeable barrier beneath the resilient layer.

7. The foundation of claim 1 wherein:

said fragments have maximum dimensions of at most about one inch.

8. The foundation of claim 1 wherein:

the fragments have maximum and minimum dimensions, with a maximum dimension of each fragment being at most about twice a minimum dimension of the fragment.

9. The foundation of claim 8 wherein:

the maximum dimensions of the fragments are in the range of about three-eighths of an inch to about three-fourths of an inch.

10. The foundation of claim 1 wherein:

said resilient material is an elastomer.

11. The foundation of claim 10 wherein:

said elastomer consists essentially of at least one of the following: vulcanized natural rubber; a butadiene-styrene copolymer, neoprene, a butadiene-acrylonitrile copolymer, and butyl rubber.

12. The foundation of claim 11 wherein:

said elastomer consists essentially of recycled rubber, shredded or crumbed.

13. The foundation of claim 1 wherein:

the thickness of the support layer is at least about two inches.

14. The foundation of claim 13 wherein:

said support layer thickness is about 3–4 inches.

15. The foundation of claim 1 wherein:

said landscaping loose-fill material consists essentially of at least one of the following: wood mulch, bark mulch, wood chips, sand, and gravel.

16. The foundation of claim 1 wherein:

the thickness of the upper layer is at least about six inches.

17. The foundation of claim 1 wherein:

said thickness of the upper layer is in the range of 6–8 inches.

18. The foundation of claim 1 wherein:

said fragments cooperate to provide a vertical support layer having a depth of at least about four inches.

19. The foundation of claim 1 wherein:

said fragments have sizes of at least about one-fourth inch.

20. A process for constructing a foundation that provides a playing surface, including:

forming a generally upright boundary for defining a play surface area and for containing loose-fill materials within the play surface area;

pouring a first loose-fill material composed of resilient fragments having sizes of at least about one-fourth inch within the playing surface area, then substantially leveling the resilient loose-fill material to form a resilient layer having a depth less than a height of the side wall;

after pouring and substantially leveling the resilient loose-fill material, and with the resilient layer retaining its loose-fill character, installing a water permeable barrier layer above the resilient layer; and after installing the water permeable barrier layer, pouring a landscaping loose-fill material having an elasticity less than that of the resilient material, above the barrier layer, and substantially leveling the landscaping loose-fill material to provide a substantially level playing surface surrounded by the boundary.

21. The process of claim 20 further including:

before said pouring of the resilient loose-fill material, installing a second water permeable barrier layer within the playing surface area.

22. The process of claim 20 wherein:

said forming of the boundary comprises an excavation of earth from the play surface area.

23. The process of claim 20 wherein:

said forming of the boundary includes installing landscaping ties.

24. The process of claim 20 further including:

substantially leveling a ground surface within the play surface area before pouring the first loose-fill material.

25. A layered foundation for a play surface including:

an upper layer including a landscaping loose-fill material having a top surface and having a depth extending downwardly from the top surface; and a support layer disposed beneath the upper layer and consisting essentially of multiple fragments of a water impermeable resilient material more elastic than the landscaping loose-fill material, said fragments contacting one another while being loosely associated with one another to form the support layer as a loose-fill layer that provides resilient vertical support to the upper layer, said fragments further cooperating to define multiple interconnected interstitial passages to promote drainage throughout the support layer, said fragments being elastically compressible in response to an application of a downward force through the upper layer.

26. The foundation of claim 25 wherein:

said fragments have maximum dimensions of at most about one inch, and minimum dimensions at least about one-fourth inch.

27. The foundation of claim 25 further including:

a water permeable barrier between the upper layer and the support layer.

28. The foundation of claim 25 wherein:

said landscaping loose-fill material includes at least one of the following: wood mulch, bark mulch, and wood chips.

* * * * *

UNITED STATES PATENT AND TRADEMARK OFFICE

CERTIFICATE OF CORRECTION

PATENT NO. : 6,287,049 B1
DATED : September 11, 2001
INVENTOR(S) : Kienholz, Shane E.

It is certified that error appears in the above-identified patent and that said Letters Patent is hereby corrected as shown below:

Title page,
Item "[76] Inventor," delete "Shane E. Keinholz, 8070 Hwy. 55, Apt. 313, Rockford, MN (US) 55373" and insert -- Shane E. Kienholz, 507 12th Street N.W., Buffalo, MN (US) 55313 --.

Signed and Sealed this

Seventh Day of May, 2002

*Attest:*

*Attesting Officer*

JAMES E. ROGAN
*Director of the United States Patent and Trademark Office*